US006461258B1

(12) United States Patent
Vacanti

(10) Patent No.: US 6,461,258 B1
(45) Date of Patent: Oct. 8, 2002

(54) NET SYSTEM FOR VOLLEYBALL OR THE LIKE

(76) Inventor: Michael M. Vacanti, 3628 Dodgeson Rd., Alexander, NY (US) 14005

( * ) Notice: Subject to any disclaimer, the term of this patent is extended or adjusted under 35 U.S.C. 154(b) by 0 days.

(21) Appl. No.: 09/888,318

(22) Filed: Jun. 25, 2001

(51) Int. Cl.[7] ..... A63B 61/00
(52) U.S. Cl. ..... 473/494
(58) Field of Search ..... 473/492, 494, 473/197, 490, 493; 248/156

(56) References Cited

U.S. PATENT DOCUMENTS 3,195,898 A * 7/1965 Respini ..... 473/197
4,009,780 A * 3/1977 Frye ..... 473/492
4,274,632 A * 6/1981 Jacobs ..... 473/492
5,176,344 A * 1/1993 Eberhard ..... 248/156

* cited by examiner

*Primary Examiner*—Paul T. Sewell
*Assistant Examiner*—M. Chambers
(74) *Attorney, Agent, or Firm*—Robert J. Bird

(57) ABSTRACT

A net system for volleyball, badminton, and the like includes first and second piers and a net with top and bottom supporting cables extending between the piers. The piers each include a base, net pole, and net tensioning spring. The bases each include longitudinal and lateral platform members, and a ground anchor. Each net pole is removably attached to its base and extends up from it. The net tensioning springs are cantilevered leaf springs, each removably attached to its base and extending up and away from its net pole. The net supporting cables pass through the net poles for attachment to the springs. The springs are flexible toward and away from their net poles in the plane of the net.

14 Claims, 4 Drawing Sheets

NET SYSTEM FOR VOLLEYBALL OR THE LIKE

BACKGROUND OF THE INVENTION

This invention is a portable system for supporting volleyball net the like.

Prior art that I know of includes the following U.S. patents:

| | | |
|---|---|---|
| 3,940,139-Barnes | 4,009,780-Frye | 4,720,112-Stettner |
| 4,732,395-Halverson | 4,830,382-Wheeler | 4,968,042-Stewart |
| 4,973,059-Stewart | 5,156,408-Hall | 5,176,344-Eberhard |
| 5,215,310-Allbright | 5,238,251-Staka | 5,269,533-Kellams |
| 5,344,157-McCord | 5,358,257-Pardi | 5,651,552-Whelchel |
| 5,816,956-Ellis | 5,885,176-Wong | 5,951,417-Ha |
| 6,030,301-Asada. | | |

U.S. Pat. No. 4,009,780—Fry and U.S. Pat. No. 5,176,344—Eberhard appear to be the most relevant of these. They both disclose portable net systems, removably "implantable", with spring means to tension the net.

SUMMARY OF THE INVENTION

In summary, this invention is a net system for volleyball, badminton, and the like. It includes first and second piers and a net with top and bottom supporting cables extending between the piers. The piers each include a base, net pole, and net tensioning spring. The bases each include longitudinal and lateral platform members, and a ground anchor. Each net pole is removably attached to its base and extends up from it. The net tensioning springs are cantilevered leaf springs, each removably attached to its base and extending up and away from its net pole. The net supporting cables pass through the net poles for attachment to the springs. The springs are flexible toward and away from their net poles in the plane of the net.

DETAILED DESCRIPTION

Figure 1:
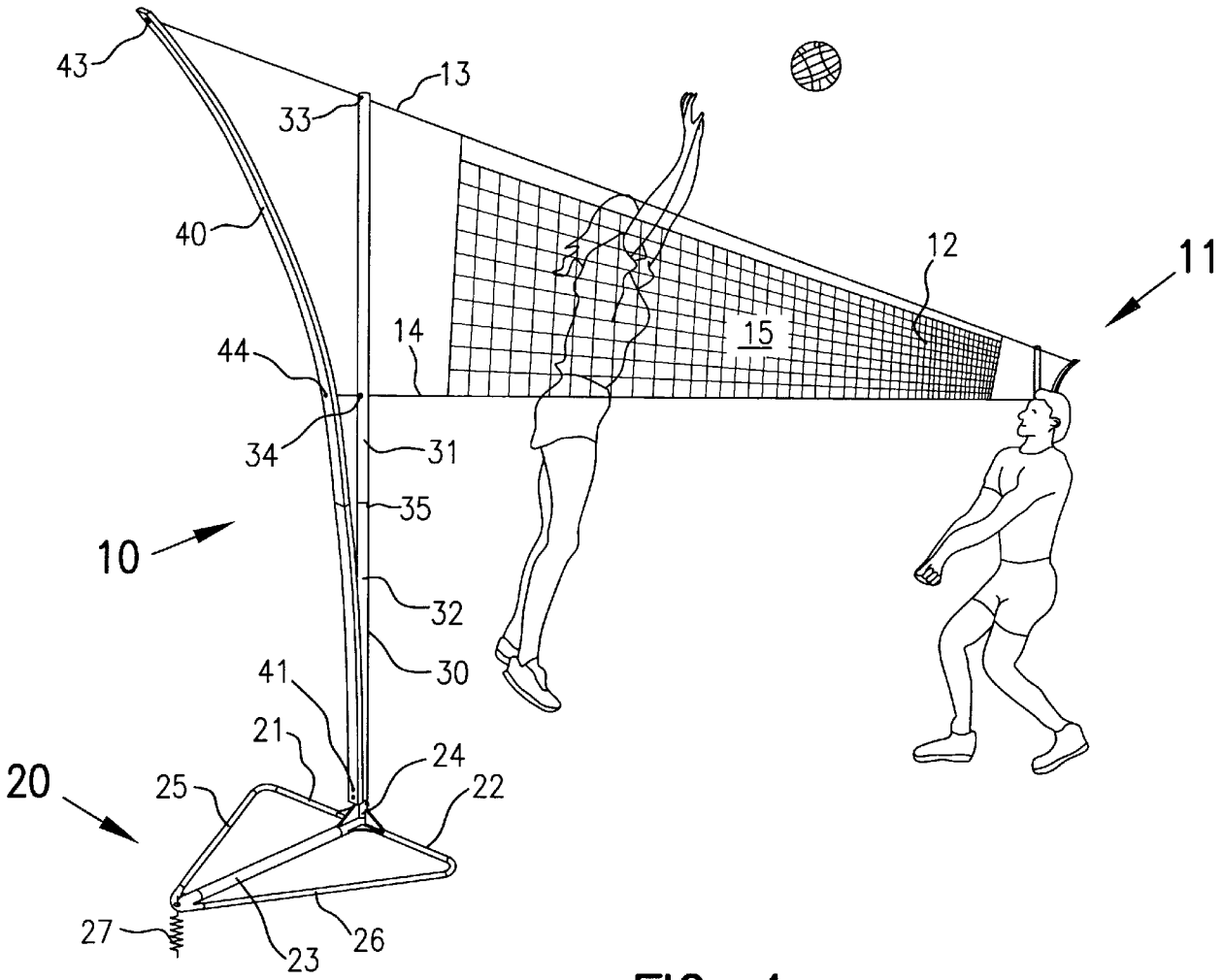
FIG. 1 shows a net system according to one form of this invention.

FIG. 1 shows a net system in one form of this invention. It includes first and second piers 10, 11 and a net 12 extending across a game court from pier 10 to pier 11. The net 12 includes top and bottom supporting cables 13, 14 and a mesh 15 supported by the cables.

Each pier 10 includes a base 20 which lies flat on the ground, a vertical net pole 30 removably attached to the base 20 and extending up from it, and a net tensioning spring 40. The base 20 is essentially a T-shaped platform including longitudinal members 21, 22 and a lateral member 23 extending from a hub 24 ("longitudinal" and "lateral" mean, respectively, lengthwise and crosswise relative to the volleyball court). In the example of FIG. 1, the base 20 further includes sides 25, 26 which, with the longitudinal members 21, 22 form a triangle. The lateral member 23 extends from the hub 24 to the apex where sides 25, 26 are joined. Each end of the lateral member 23 includes a ground anchor 27, preferably in the form of a helix to screw into the ground and provide a positive grip. The base might take a simpler form, without the sides 25, 26.

The net pole 30 may be of a single piece or, preferably, of two or more pole pieces attached end-to-end. If the pole 30 is of two or more pieces, they may be telescoped together so as to collapse most conveniently and with the least bulk. In the example shown, the pole 30 includes two pieces 31, 32 locked together end to end. The top pole piece 31 includes transverse holes 33, 34 for passage of, respectively, the top and bottom net supporting cables 13, 14. A snap locking device 35 releasably locks the pieces 31, 32 together.

The net tensioning spring 40 is a cantilevered leaf spring. It is fastened at its bottom end to the base 20 by suitable fasteners 41. The spring 40 may be of a single piece or of two pieces, as shown in FIG. 1. The spring 40 extends up from the base 20 and away from the net pole 30 so that it has room for flexure. The spring 40 includes suitable fasteners or clamps 43, 441 by which to anchor the net cables 13, 14 respectively. The clamps 43, 44 are located on the spring 40 at positions corresponding to those of the holes 33, 34 in the net pole 30. The spring 40, pole 30, and net 12 are coplanar. Flexure of the spring is in the plane of the spring, pole, and net.

The net system is erected by placing the two bases 20 at appropriate positions, anchoring them to the ground by means of the ground anchors 27, mounting the poles 30 and springs 40, then stringing the net cables 13, 14 through the poles and clamping them to the springs.

Figure 2:
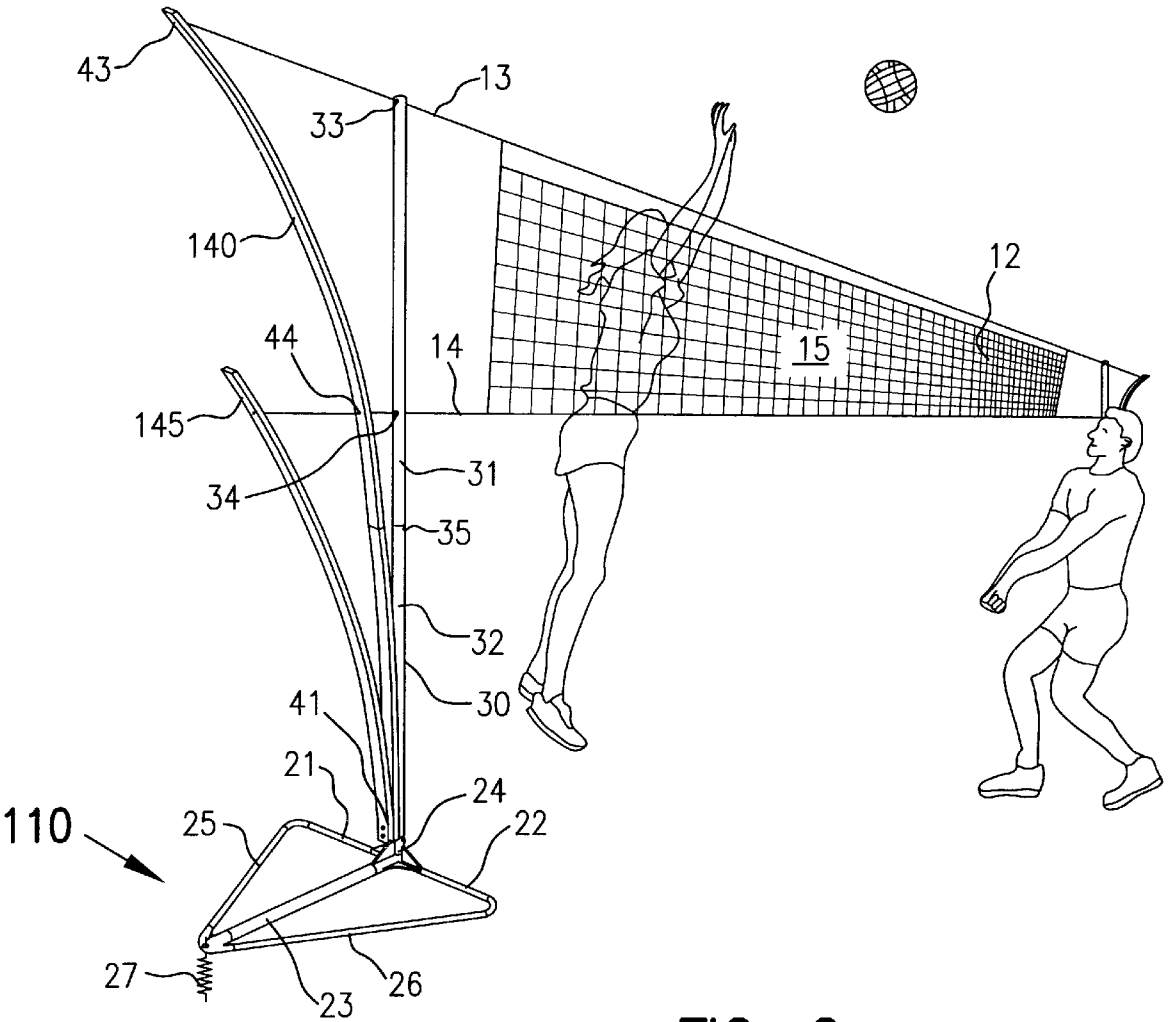
FIG. 2 shows one end of a net system in a second form of this invention.

FIG. 2 represents a net system in a second form of this invention. It includes a pier 110 on each side of a game court. Each pier 110 includes a base 20 and vertical net pole 30 (as in FIG. 1), and net tensioning springs 140, 145.

The net tensioning springs 140, 145 are cantilevered leaf springs, each fastened at its bottom end to the base 20 by suitable fasteners and extending up and away from the base 20 and the net pole 30. In this embodiment, one spring 140 is connected to the upper net cable 13, and the other spring 145 is connected to the lower net cable 14. As in FIG. 1, the springs 140, 145, net pole 30, and net 12 are coplanar, and flexure of the springs is in the plane of the springs, pole, and net.

Figure 3:
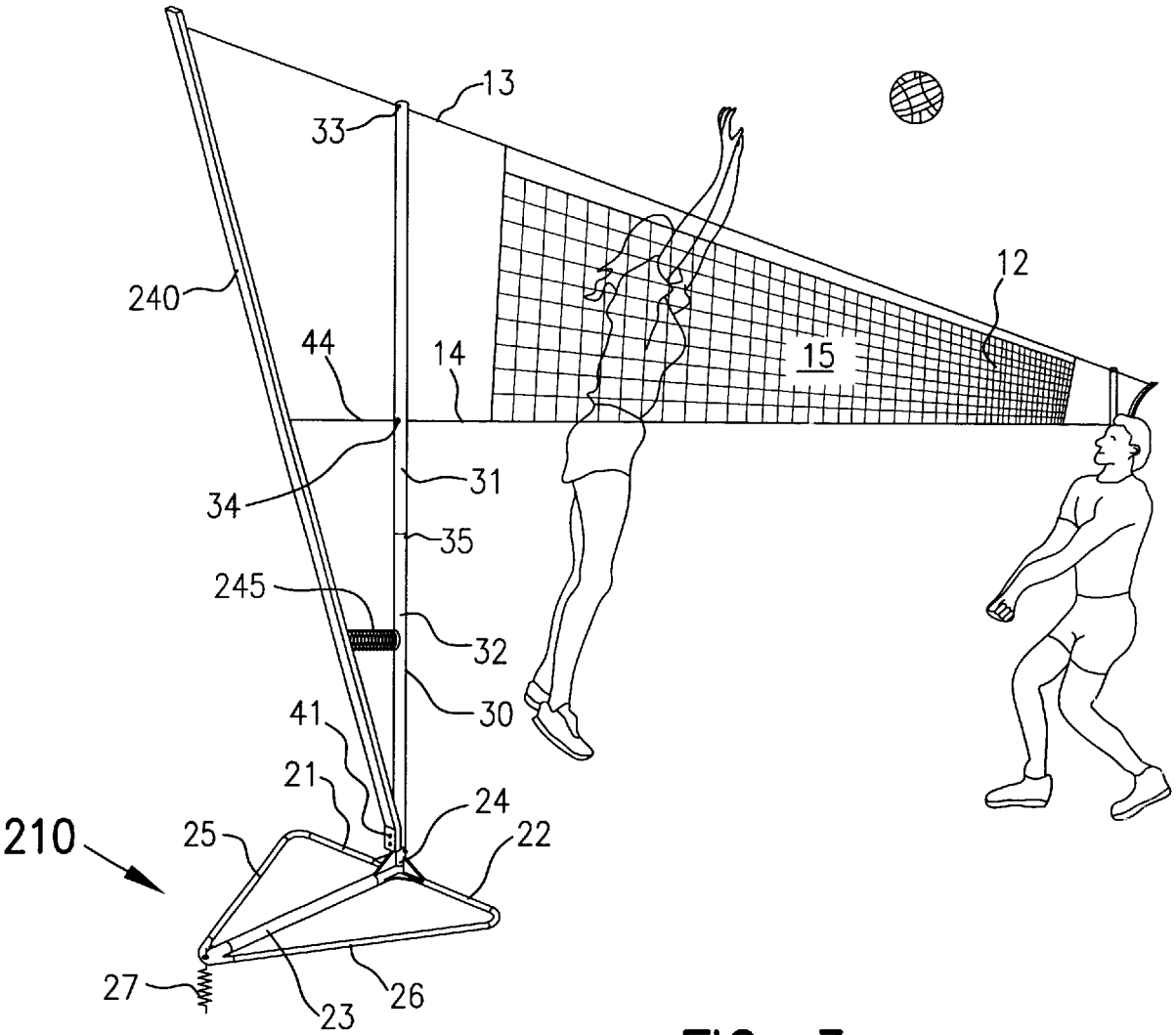
FIG. 3 shows one end of a net system in a third form of this invention.

FIG. 3 represents a net system in a third form of this invention. It includes a pier 210 on each side of a game court. Each pier 210 includes a base 20 and vertical net pole 30 (as in FIGS. 1 and 2), and a net tension lever 240.

The net tension lever 240 is pivotally mounted to the base 20, and extends up and away from the base 20 and the net pole 30. The net cables 13, 14 are connected to the lever 240. This embodiment further includes a compression spring 245 between the lever 240 and the net pole 30 to keep the net cables 13, 14 in tension. As in FIGS. 1 and 2, the lever 240, net pole 30, and net 12 are coplanar, and spring flexure is in the plane of the lever, pole, and net.

Figure 6:
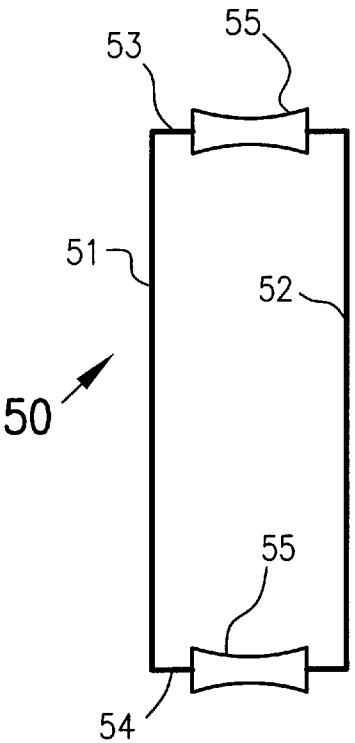
FIG. 6 is a detail view of a component from FIGS. 4, 5.
Figure 5:
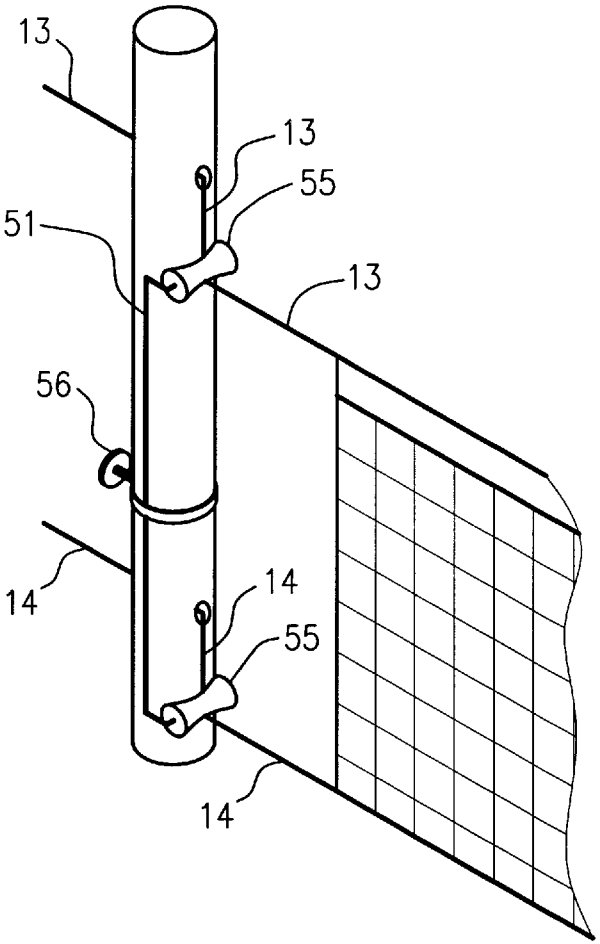
FIGS. 4, 5 are enlarged views of the upper part of a net pole of this invention.
Figure 4:
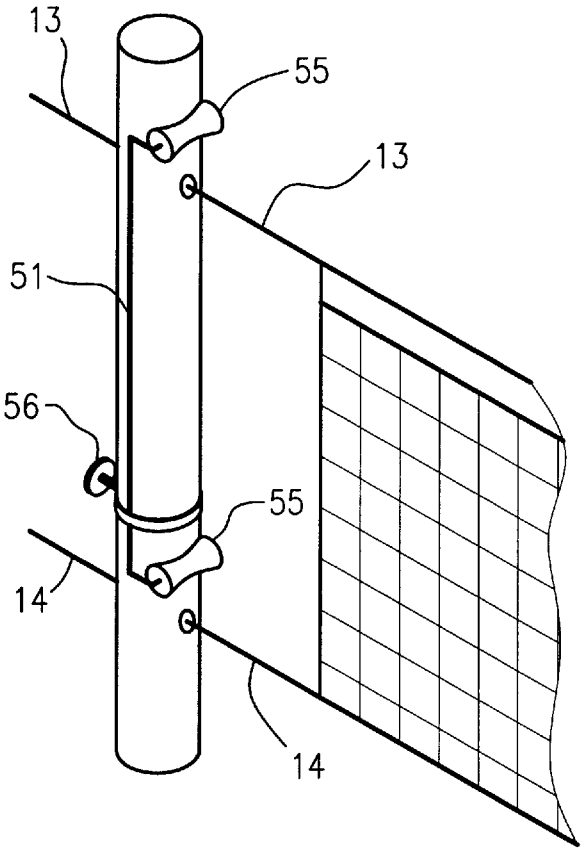

FIGS. 4–6 show my system for varying the height of the net. It includes a net adjuster bracket 50 mounted on the net pole 30. The adjuster bracket 50 includes vertical sidebars 51, 52 connected at top and bottom by horizontal crossbars 53, 54 which are spaced apart by the same center-to-center distance as the holes 33, 34 in the net pole 30. A roller or bearing 55 is mounted on each crossbar. The bearing 55 is concave to roll along, or slide along, the cylindrical surface of the net pole 30. The adjuster bracket 50 is releasably clamped to the net pole 30, by a clamp or other suitable means 56.

In FIG. 4, the net 12 is at a certain height (e.g. regulation height for volleyball) with cables 13, 14 passing straight through, respectively, holes 33, 34 in the net pole 30. The adjuster bracket 50 is in an out-of-the-way position.

FIG. 5 shows the adjuster bracket 50 moved to a lower position and secured there by tuhe clamping means 56. In moving to that lower position, the rollers or bearings 55 have pulled the net cables 13, 14 down with them, so the net is now in a lower position (e.g. for badminton, or for children's volleyball).

Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A game net system, including first and second piers and a net extending therebetween, said net including top and bottom supporting cables;

each said pier including a base, a net pole, and a net tensioning spring;

said base including longitudinal and lateral members forming a platform, and a ground anchor at the outer end of said lateral member;

said net pole removably attached to said base and extending upward therefrom, said net pole including upper and lower transverse holes for passage therethrough of, respectively, said top and bottom supporting cables;

said net tensioning spring being a cantilevered leaf spring removably attached to said base and extending upward therefrom and away from said net pole, said spring including upper and lower clamping means to clamp, respectively, said top and bottom supporting cables to said spring;

said spring being flexible toward and away from said net pole in the plane of said net.

2. A net system as defined in claim 1, said longitudinal and lateral members forming a T-shaped platform.

3. A net system a s defined in claim 1, in which said ground anchor includes a helix to screw into the ground to provide positive ground grip.

4. A net system as defined in claim 1, in which said net pole includes a plurality of pole pieces releasable attached end-to-end.

5. A net system as defined in claim 1, in which said net pole includes a plurality of pole pieces telescoped together.

6. A net system as defined in claim 1, in which said net tensioning spring includes a plurality of pieces attached end-to-end.

7. A net system as defined in claim 1, in which said ground anchor includes a helix to screw into the ground to provide positive ground grip; said net pole includes a plurality of pole pieces releasable attached end-to-end; and said net tensioning spring includes a plurality of pieces attached end-to-end.

8. A game net system, including first and second piers and a net extending therebetween, said net including top and bottom supporting cables;

each said pier including a base, a net pole, and a net tension lever;

said base including longitudinal and lateral members forming a platform, and a ground anchor at the outer end of said lateral member;

said net pole removably attached to said base and extending upward therefrom, said net pole including upper and lower transverse holes for passage therethrough of, respectively, said top and bottom supporting cables;

said net tension lever being pivotally mounted to said base and extending upward therefrom and away from said net pole, said lever including upper and lower clamping means to clamp, respectively, said top and bottom supporting cables to said lever;

a compression spring disposed between said lever and said net pole to keep said net cables in tension;

said lever being movable toward and away from said net pole in the plane of said net.

9. A net system as defined in claim 8, further including a net adjuster bracket mounted on each said net pole, said bracket including:

vertical sidebars connected by horizontal crossbars, said crossbars separated by the same center-to-center distance as said transverse holes in said net pole;

a concave bearing on each said crossbar to engage said supporting cables to lay said cables against said net pole as said bracket is moved vertically there along, thereby to adjust the height of said net; and means to releasably clamp said bracket to said net pole.

10. A net system as defined in claim 8, said longitudinal and lateral members forming a T-shaped platform.

11. A net system as defined in claim 8, in which said ground anchor includes a helix to screw into the ground to provide positive ground grip.

12. A net system as defined in claim 8, in which said net pole includes a plurality of pole pieces releasable attached end-to-end.

13. A net system as defined in claim 8, in which said net pole includes a plurality of pole pieces telescoped together.

14. A net system as defined in claim 8, in which said ground anchor includes a helix to screw into the ground to provide positive ground grip; said net pole includes a plurality of pole pieces releasable attached end-to-end; and said net tensioning spring includes a plurality of pieces attached end-to-end.

* * * * *